US006277059B1

(12) United States Patent
Groenenberg

(10) Patent No.: US 6,277,059 B1
(45) Date of Patent: Aug. 21, 2001

(54) FOLDING APPARATUS FOR THE DOUBLE-FOLDING OF A SHEET

(75) Inventor: Cornelis Jacobus Groenenberg, Venlo (NL)

(73) Assignee: Oce-Technologies B.V., a Venlo (NL)

( * ) Notice: Subject to any disclaimer, the term of this patent is extended or adjusted under 35 U.S.C. 154(b) by 0 days.

(21) Appl. No.: 09/276,828

(22) Filed: Mar. 26, 1999

(30) Foreign Application Priority Data

Mar. 27, 1998 (NL) ..... 1008726

(51) Int. Cl.[7] ..... B31F 01/00

(52) U.S. Cl. ..... 493/417; 493/444; 493/457; 493/37

(58) Field of Search ..... 493/417, 442, 493/444, 457, 478, 479, 397, 405, 37

(56) References Cited

U.S. PATENT DOCUMENTS

| | | | | |
|---|---|---|---|---|
| 3,485,492 | * | 12/1969 | Iltis | 493/37 |
| 3,843,113 | * | 10/1974 | Scgaffer | 493/444 |
| 4,059,258 | * | 11/1977 | Grantham | 493/444 |
| 4,083,552 | * | 4/1978 | Sioman | 493/444 |
| 4,578,052 | * | 3/1986 | Engel et al. | 493/37 |
| 5,461,469 | | 10/1995 | Farrell et al. . | |
| 5,628,501 | * | 5/1997 | Meier | 493/444 |
| 5,683,338 | * | 11/1997 | Krasuski et al. | 493/37 |
| 6,004,254 | * | 12/1999 | Murata | 493/444 |

FOREIGN PATENT DOCUMENTS

| | | |
|---|---|---|
| 3544495 | 6/1987 | (DE) . |
| 9104607 | 8/1991 | (DE) . |

OTHER PUBLICATIONS

EPO, Patent Abstract of Japan, JP 62–211247, Publication Date 09/17/1987, Mikami Noriaki.

* cited by examiner

*Primary Examiner*—Eugene Kim

(57) ABSTRACT

A folding device for double-folding a sheet or a plurality of sheets for folding into a booklet. The folding device comprises a collecting tray provided with adjustable stops between which the sheets to be folded are collected. In a sheet feed path to the collecting tray there is disposed a measuring wheel which is set into rotation by a sheet as they are displaced, said wheel measuring the length of the supplied sheet. On the basis of said measurement, the stops are adjusted so that the center between the stops corresponds to the place where folding rollers fold the sheet.

14 Claims, 6 Drawing Sheets

FOLDING APPARATUS FOR THE DOUBLE-FOLDING OF A SHEET

BACKGROUND OF THE INVENTION

The present invention relates to a folding device comprising a folding station for double-folding at least one sheet, which folding station is provided with folding means disposed at a fixed place, a feed path for introducing the sheet to be folded to the folding station and adjustable positioning means for positioning the still unfolded sheet with respect to the folding means so that the folding means, following after positioning, can fold the sheet on its intended fold line.

More particularly, the present invention relates to a folding device wherein the folding station comprises a collecting station for collecting a number of sheets and wherein the folding means are adapted for folding the collected sheets together on their intended fold line.

A general device of this kind is known from U.S. Pat. No. 5,461,469. In the device described therein, the folding station is provided with positioning means which are constructed as a stop, adjustable in the direction in which the sheets for folding are introduced. When, in this known device, a sheet or booklet is folded on a fold line which is not situated centrally, then on the basis of that result the stop is automatically adjusted over a distance such that the intended fold line of a following sheet or booklet does coincide with the center. A disadvantage of this known device is that whenever a series of identical sheets or booklets is folded, the first sheet or booklet may be folded incorrectly and thus become unusable.

SUMMARY OF THE INVENTION

The object of the invention is to provide a folding device for the double-folding of a sheet.

To this end, according to the present invention, the feed path of the folding device is provided with measuring means for measuring the length of a supplied sheet and the adjustable positioning means are adjustable to the length of said supplied sheet as measured by the measuring means, for exact positioning of said sheet with its intended fold line straight opposite the folding means. As a result, a booklet is formed from a number of double-folded sheets wherein the sheet edges are situated substantially straight above one another. Preferably, the positioning means comprise a first stop for the leading edge of a supplied sheet, which first stop, as considered in the sheet feed direction, is adjustable to a distance from the folding means corresponding to half the length of the sheet as measured by the measuring means plus a predetermined distance. As a result, at least the longest sheet of the sheets belonging to a folded booklet can be folded on a line exactly at the center of the sheet, because after collection of these sheets against the stop, and possible stapling of the sheets on that line, the sheets are brought into the folding position by displacement of the stop over the predetermined distance in a direction opposed to the feed direction. Since the collected sheets are moved back over the predetermined distance from the collecting position to the folding position, the resulting device is also of compact construction.

In one advantageous embodiment of a device according to the present invention, the positioning means further comprise a second stop for the trailing edge of a supplied sheet, which second stop, as considered in the sheet feed direction, is adjustable to a distance from the first stop corresponding to the length of said sheet as measured by the measuring means. As a result, sheets collected between the first and second stops remain enclosed, even if the stops are displaced in a direction opposed to the sheet feed direction.

If the adjusted distance between the first and second stops is at minimum equal to the measured length of a supplied sheet, then the sheets are collected so as to fit between the stops, thus permitting a low overall height for the device, but, if required, guide means can be provided to ensure good sheet feed. If the adjusted distance between the first and second stop is at maximum equal to the measured length of a supplied sheet, then the sheets are collected with a loop formation between the stops, but if required swing-up parts of the device will enable a loop to form.

BRIEF DESCRIPTION OF THE DRAWINGS

These and other features and advantages will be explained hereinafter with reference to the accompanying drawings wherein.

DETAILED DESCRIPTION OF THE INVENTION

Figure 1:
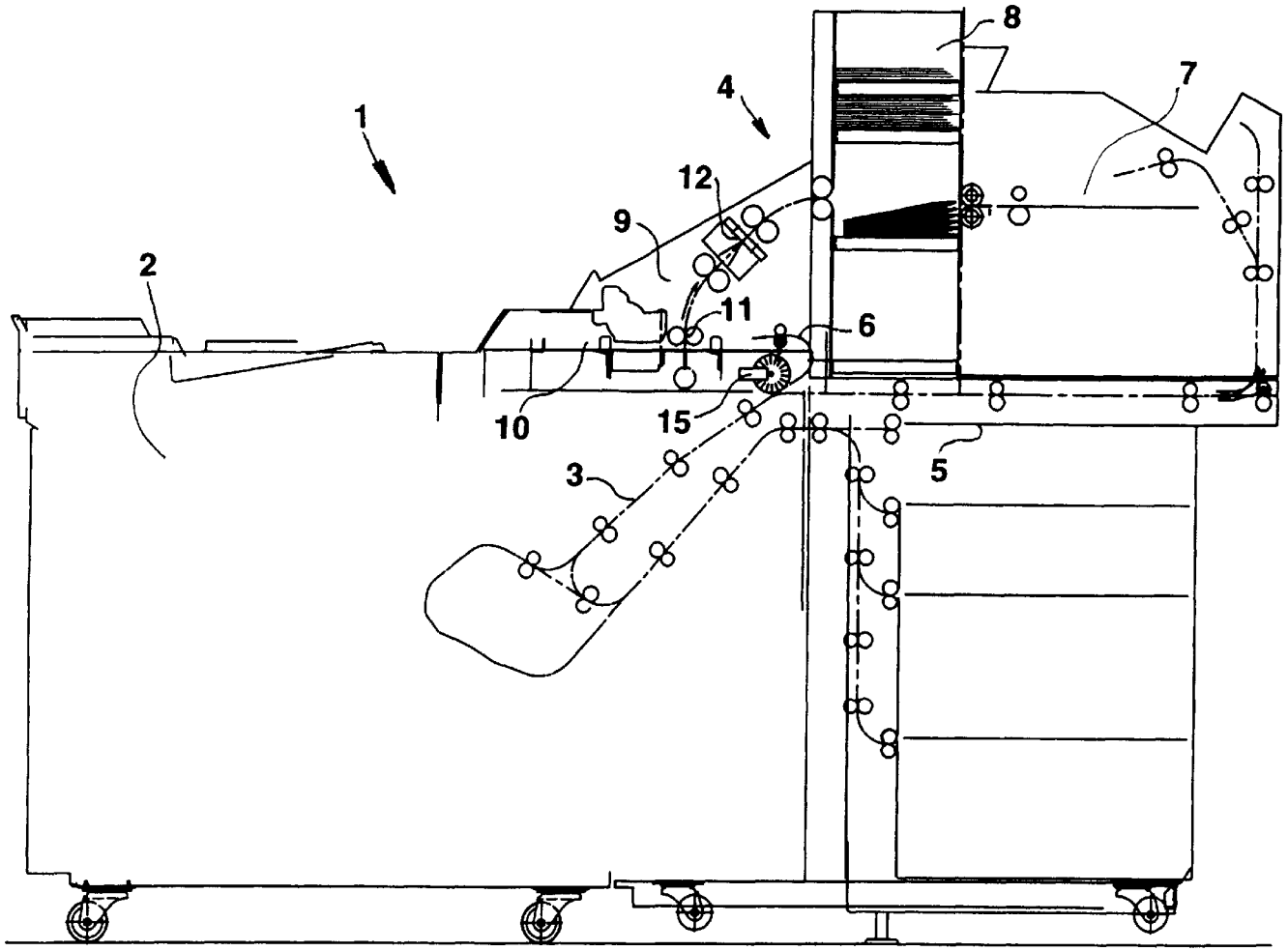
FIG. 1 shows a printing apparatus in which a device according to the invention can be used.

The printing apparatus 1 shown in FIG. 1 comprises a printing section 2, denoted by peripheral lines, in which sheets of receiving material can be printed on both sides with two images disposed next to one another. The printing apparatus 1 is provided with a sheet transport path 3 for transporting sheets thus printed with four images from the printing section 2 to a sheet finishing station 4 disposed at the top of the printing section 2. The sheet transport path 3 divides into a path 5 and a path 6. Path 5 is used for transporting sheets printed with an image on each side, and which do not need to be folded together but are to be bundled individually by the application of a staple in stapling station 7 and then delivered to delivery station 8. Path 6 serves for transporting sheets printed with two images on each side to a folding and creasing device 9. In the folding and creasing device 9 a number of sheets can be collected at a collecting station 10 and then double-folded together in a folding nip 11 and finally pressed flat in a creasing station 12. Folded booklets pressed flat in this way can easily be stacked in delivery compartments of the delivery station 8 without the stack height becoming unduly high.

A measuring device 15 is disposed in the sheet transport path 3 to measure the length of a sheet which is to be fed to the folding and creasing device 9. This measuring device will be described hereinafter in detail with reference to FIG. 6.

Figure 2:
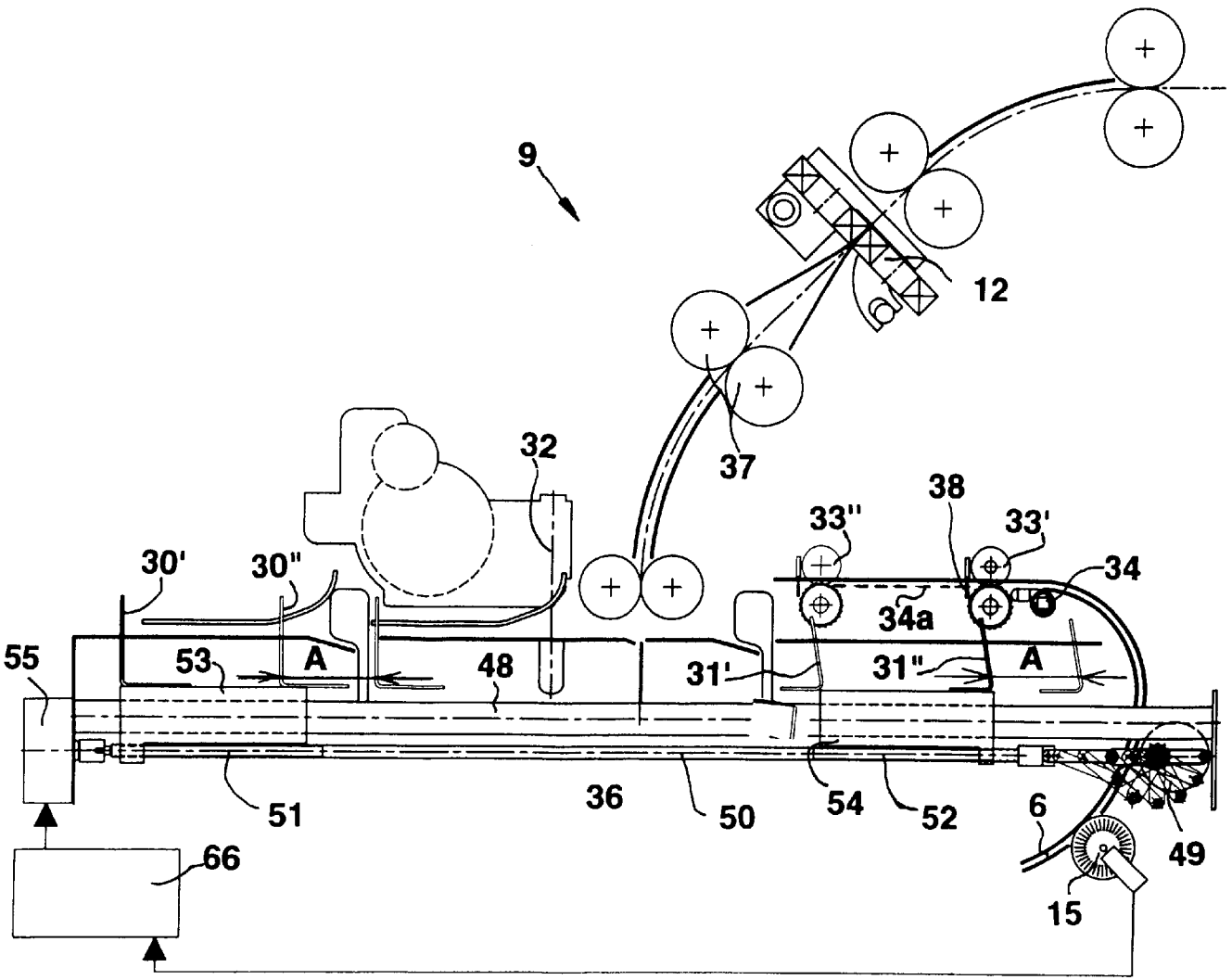
FIG. 2 shows a device according to the invention.

FIG. 2 shows an embodiment of the folding and creasing device 9. This device comprises a collecting tray 10 which extends horizontally and which is adapted to collect copy sheets of different sheet formats, e.g. the European sheet formats A3 (420×297 mm), A4 (297×210 mm), format B4 (364×257 mm) and the American sheet formats ledger (432×279 mm), letter standard (279×216 mm) and legal standard (356×216 mm).

Figure 3B:
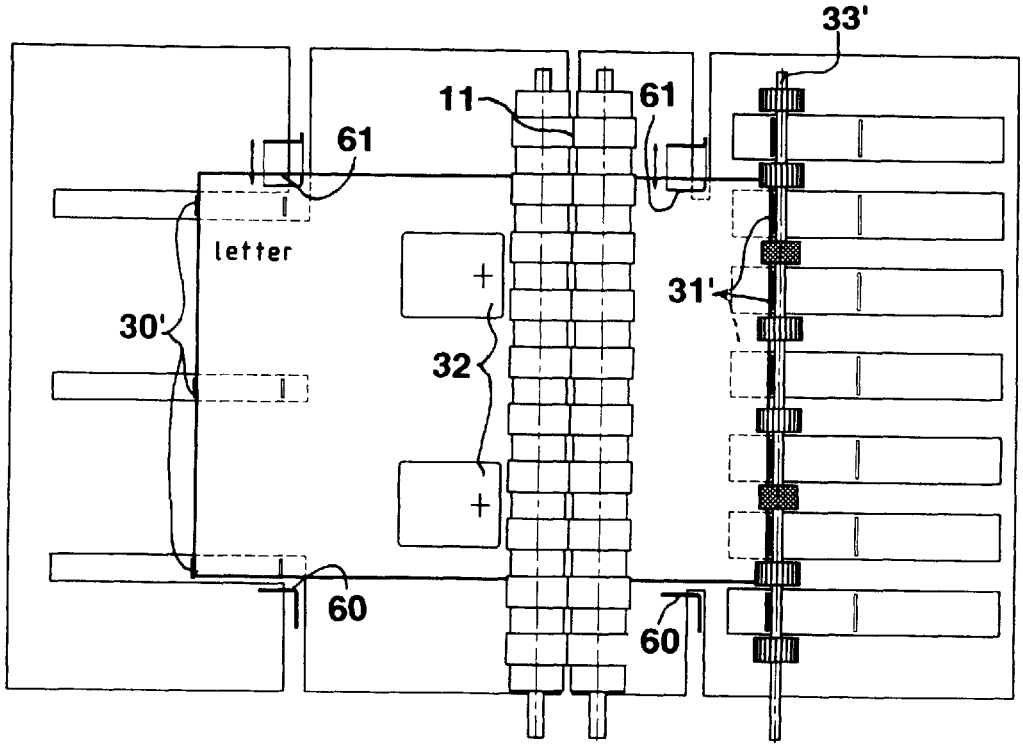
FIG. 3B shows the device of FIG. 2 in top plan view, with a smallest sheet positioned therein.
Figure 3A:
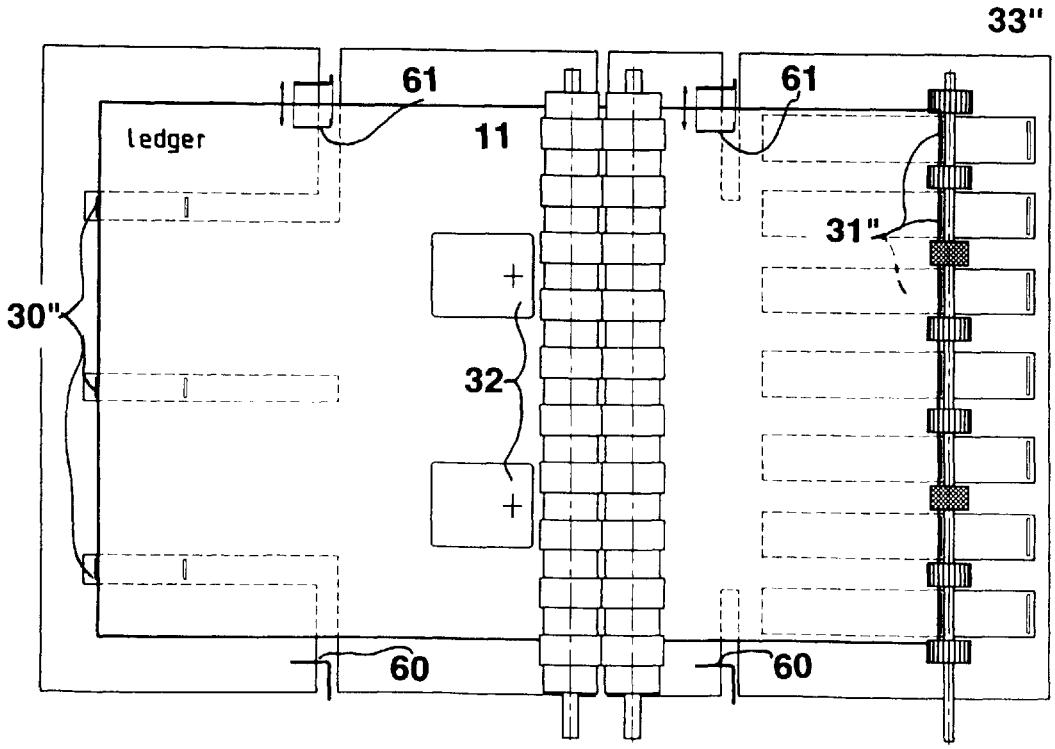
FIG. 3A shows the device of FIG. 2 in top plan view, with a largest sheet positioned therein.

To adjust the collecting tray 10 to the different sheet formats, the tray 10 is provided with adjustable stops 30 and 31 which can be set at a distance from one another varying between the longest sheet format (ledger with a length of 432 mm), as shown in FIG. 3A, and the shortest sheet format (letter standard with a length of 279 mm), as shown in FIG. 3B.

For the supply of a number of sheets folded to form a booklet, stops 30 and 31 are set to a position such that the distance therebetween corresponds to the length of the sheets for folding and that two stapling heads 32 disposed next to one another above the collecting tray 10 are situated exactly in the center between the stops 30 and 31. In FIG. 2 and in FIGS. 3A and 3B, the stops 30 and 31 are shown in their extreme positions (respectively 30' and 31' and 30" and 31"). A transport roller pair 33 which feeds the sheets for collection from the transport path 6 into the collecting tray 10 is adjustable together with the stop 31. In position 33' the roller pair 33 is set to the supply of the longest sheet format, while in position 33" it is set to the supply of the shortest sheet format. In order to bridge the distance between the feed path 6 and the collecting tray 10 in the position 33", an unrollable sheet guide belt system 34 is fixed at the end of the feed path 6, the belt end being fixed to the displacement mechanism for the transport roller pair 33. On displacement of the transport roller pair 33 from the position 33' to 33", the belt 34*a* unrolls to act as a bottom guide for the sheet. Sawtooth wheels 35 are mounted on the shaft of the bottom roller of the transport roller pair 33. On the passage of the trailing edge a sawtooth engages said edge and presses it down, being supported by a hold-down device which firmly presses the trailing sheet edge against the sawtooth wheels, as will be explained in detail hereinafter with reference to FIGS. 4 and 5.

The abutment stop 30 and the inlet stop 31 form the front and rear boundary of the collecting tray 10. As shown in FIG. 2, beneath the collecting tray 10, there extend a guide rod 48 and a drivable shaft 50 having ends 51 and 52 which are provided with a left-hand and right-hand screwthread, respectively. The stops 30 and 31 are each provided with guide blocks 53 and 54 which contain screw holes having a left-hand and right-hand screwthread, respectively. By rotation of the shaft 50 by a motor 55, the stops 30 and 31 move toward or away from one another, their distances from the stapling head 32 remaining the same. The stops 30 and 31 are set at a nominal distance from one another corresponding to the length of the standard format being processed. When sheets to be folded into a folded booklet are collected between the stops 30 and 31 they are pushed straight laterally, in each case after a sheet has been fed. For this purpose, a fixed side stop 60, shown in FIGS. 3A and 3B is adjusted to the width of the standard format being processed and two laterally movable members 61, after a sheet has been centrally fed into the tray 10, are moved in the direction of the fixed side stop 60 in order to press the sheet straight against it.

After a maximum number of sheets, for example 15, has been collected between the adjusted stops 30 and 31, the two stapling heads 32 disposed next to one another each press a staple downwards on to a center-line, through the collected sheets. Stop 30 is then moved over a distance A on towards the center of the collecting tray 10. This is shown in FIG. 2 for stop 30 in the case of the smallest sheet format and for stop 31 in the case of the largest sheet format. Stop 31 also moves over the same distance A so that the distance between the stops 30 and 31 remains the same. The joint displacement of the stops 30 and 31 over the distance A is obtained by moving the drivable shaft 50 over the distance A by a crank drive mechanism 49. The transport roller system 33 coupled to stop 31 is decoupled from the stop 31 on movement of the stop 31 from the outermost collecting position 31' over the distance A in order that the feed path 6 need not require a horizontal termination in order to allow an extra translatory movement of the transport roller system 33. In the position of the stops 30 and 31 now reached, the stapled sheets are situated with their staples exactly beneath the folding nip of the folding rollers 11. A folding blade 36 then moves up to press the sheets between the folding rollers 11 and thus fold them double on the staple line. The folded sheets are then fed to the creasing device 12 by a pair of transport rollers 37. By interrupting the drive of the rollers 37 the folded sheets are stopped with their fold line on the creasing line. The distance between the collecting tray 10 and the creasing device 12 is larger than half the length of the maximum sheet format (half the length of the ledger size=½×432 mm=216 mm. Thus with a booklet held fast in a flattened position a start can already be made in collecting sheets belonging to a following booklet. The transport roller pair 37 is disposed at a distance in front of the creasing device 12 shorter than half the length of the smallest sheet format (half the letter standard length=½×279 mm=139.5 mm), but preferably as small as possible so that during creasing, a booklet is stopped as close as possible to the creasing line, e.g. at a distance of 86 mm in front of the creasing line.

Figure 5:
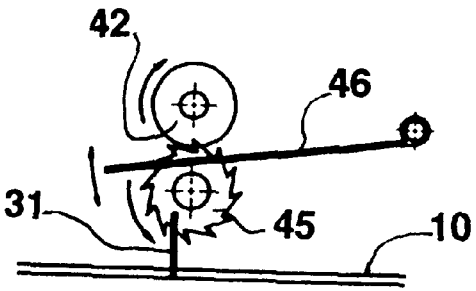
FIG. 5 is a cross-section of a detail of the device shown in FIG. 2.
Figure 4:
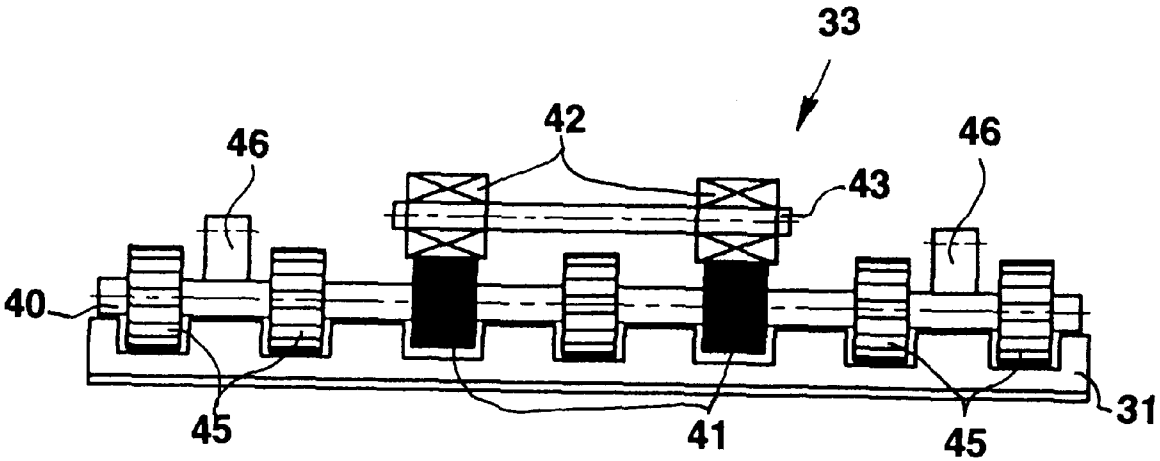
FIG. 4 is a longitudinal section of a detail of the device shown in FIGS. 2 and 3.

The transport roller system 33 shown in greater detail in FIGS. 4 and 5, for supplying the sheets for collection to the collection tray 10, has a number of functions. In addition to supplying the sheets, it also serves to stiffen the sheet in the feed direction and press down the trailing sheet edge against the inlet stop 31. For this purpose, system 33 comprises a bottom drivable shaft 40 on which two rubber drive rollers 41 are fixed. Rollers 41 co-operate with two pressure application rollers 42, which are fixed to be freely rotatable on a stationary shaft 43 thereabove. A number of sawtooth-shaped wheels 45 are fixed on the bottom shaft 40. The trailing edge of a sheet fed through the transport nip formed by transport rollers 41 and 42 is engaged by one of the wedge-shaped tooth cavities of wheels 45 and remains pressed in this cavity until the trailing sheet edge abuts the inlet stop 31 and then is disengaged from the wheels 45. To ensure good engagement by the sawteeth with sheets which are intensely curled and the trailing edge of which extends upwardly, pressure application members 46 are disposed next to the wheels 45 for pressing down any curled-up sheet edge. The sawtooth wheels 45 have a diameter somewhat larger than the diameter of the rubber drive rollers 41, so that a supplied sheet is to some extent corrugated in the transverse direction so that it has more stiffness in the direction of the feed. In this way a sheet can be fed more easily to a position against the abutment stop 30 without the sheet turning over. In order to eliminate static electricity from the supplied sheets a static eliminator 38 shown in FIG. 2 is disposed just after the inlet nip. This prevents supplied sheets from sticking to one another or from sticking to parts of the collecting tray 10, something which would interfere with the collecting process.

In the feed direction, a supplied sheet is clamped between the stops 30 and 31 which have previously been adjusted symmetrically with respect to the measured stapling position by control device 66, by adjustment of the stops on the basis of the sheet length. On adjustment of the stop 31 for the trailing edge, the feed roller system 33, shown in detail in FIGS. 4 and 5 also moves to prevent curled sheets from catching behind the sawtooth wheels 45.

The length of sheets of a specific standard format for collection may differ a few millimetres as a result of cutting tolerances and differences in moisture. Moisture differences can arise due to climatic differences in the room in which the sheets are present. Differences in heating experienced by the sheets during the printing process can also cause length differences. If the length of a sheet fed to the collecting tray 10 differs, for example, 2 mm from the nominal length of the standard format and if the abutment stop 30 is set to said standard format, the stapling head 32 during stapling will be situated 1 mm off-center of the sheet. Consequently the collected sheets will also be folded 1 mm off-center. As a result, the folded booklet will have a leg length difference of 2 mm. One leg is 1 mm too short and the other leg is 1 mm too long. By measuring the length of each sheet and, for example, in the case of a sheet 2 mm longer than the standard format to which the stops 30 and 31 have been set, to receive said sheet, and by moving the stops by a control device 66 and motor 55 a distance of 1 mm further away from the stapling position, the stapling position remains positioned straight above the center of the sheet, so that the sheet can be stapled and folded exactly in the center of the sheet and hence there are no leg length differences.

Figure 6B:
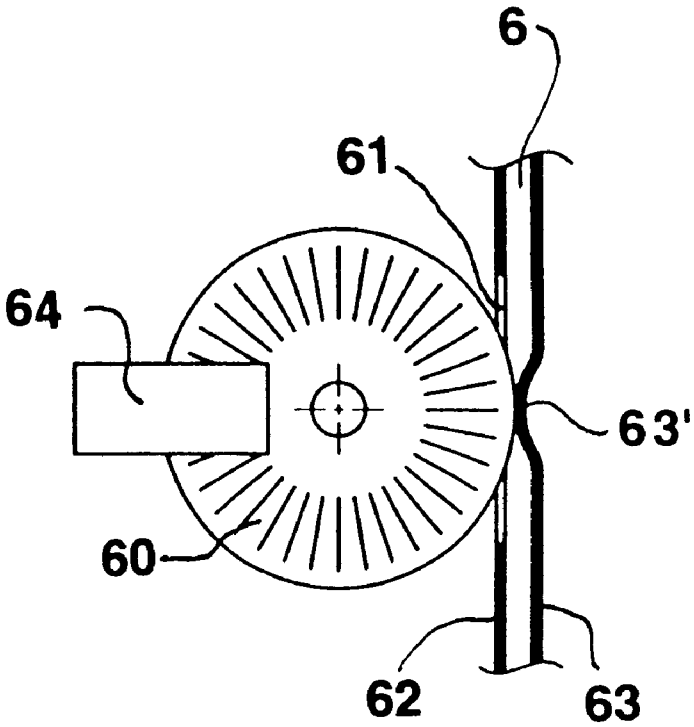
FIG. 6B shows a second embodiment of a measuring system for the sheet length.
Figure 6A:
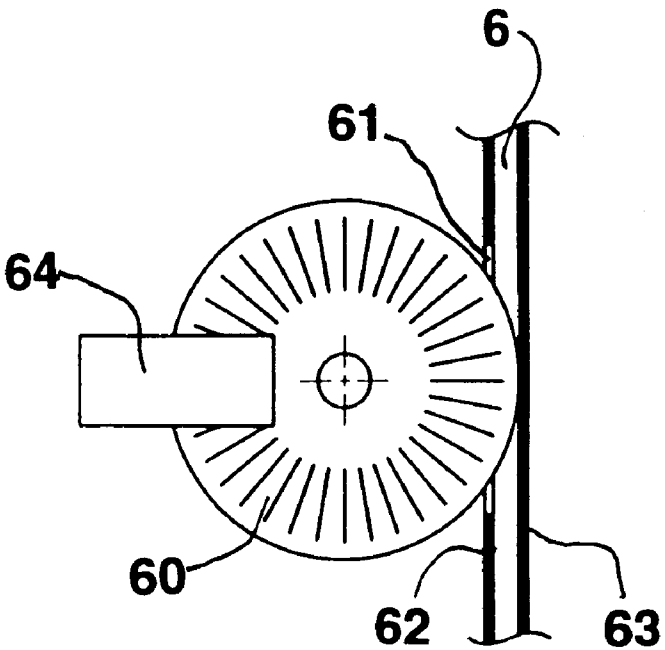
FIG. 6A shows a first embodiment of a measuring system for the sheet length.

The sheet measuring device 15 shown in FIG. 6A comprises a measuring wheel 60 which extends through an opening 61 in one of the guide plates 62 of the sheet transport path 6 and the periphery of which is in pressure contact with the other guide plate 63 of the path 6. The freely rotatable measuring wheel 60 will only rotate when a sheet moves between the measuring wheel 60 and the guide plate 63. The measuring wheel is provided, for example, with 120 slits which generate 480 pulses per revolution of the measuring wheel, said pulses being detectable by a sensor 64 (encoder). Given a slip-free drive of the measuring wheel 60 by a supplied sheet, the sheet length can be derived from the number of pulses counted by the sensor 64 and the sheet length can, for example, be measured with an accuracy of 0.2 mm.

The above-described sheet length meter has been tested with 65, 80 and 100 g/m2 sheets of different lengths. Since the sheet for measurement already drives the measuring wheel 60 before the front edge is located beneath the center of the wheel and still drives it when the rear edge is already past the center of the wheel, there is a deviation which has to be corrected. This deviation increases with the thickness of the paper. By carrying out a number of measurements, in which the actual (manually measured) sheet length is compared with the number of measurement pulses of the measuring wheel, a formula is obtained for the sheet length as a function of the number of measuring pulses:

Sheet length=A*number of pulses−B, where A is the distance covered by the periphery of the measuring wheel between two pulses and B is the extra displacement of the measuring wheel as a result of the sheet thickness.

In this way tests give the prospect of a simple length measurement with an accuracy of +/−0.5 mm. The stops 30 and 31 are in this way adjustable with sufficient accuracy, taking into account the adjustment accuracy of the construction (about +/−0.5 mm).

The sheet length measuring device 15 shown in FIG. 6B differs from the device 15 shown in FIG. 6A in that the guide plate 63 has a groove 63' facing the measuring wheel 60 at the site of the contact line with the measuring wheel 60. As a result, even a relatively thick sheet can reach a position just beneath the center of the measuring wheel before the measuring wheel is turned.

Figure 7:
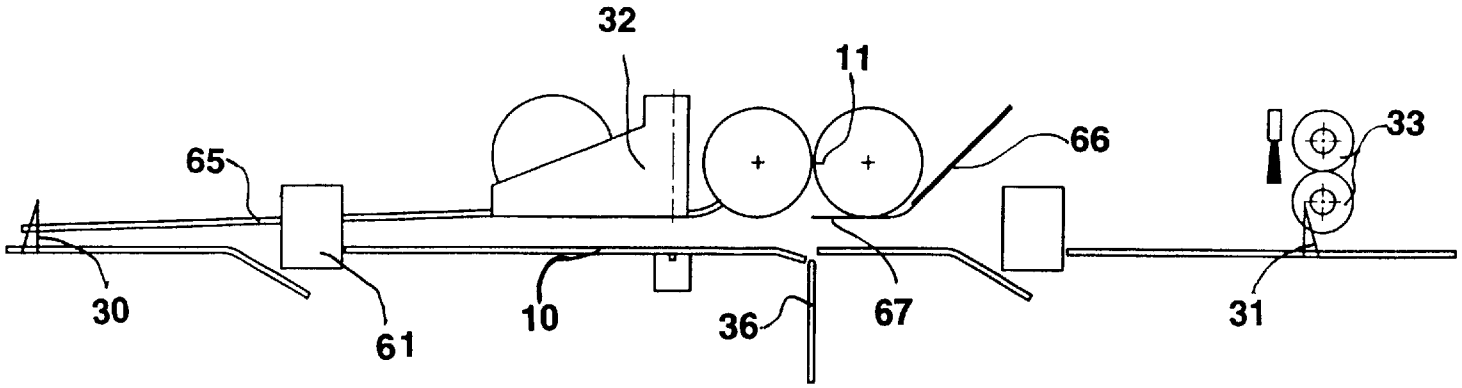
FIG. 7 shows a first embodiment of a part of a device according to the invention.

One embodiment for the collection of sheets for folding will now be described with reference to FIG. 7, wherein the stops 30 and 31 can be adjusted so as to fit the measured sheet format. Since the sheets for collection fit between the stops, they remain in a flat orientation during the collection. As a result of this flat sheet orientation, the stapling head 32 and the folding rollers 11 can be disposed a short distance above the collecting tray 10, e.g. at a distance of 10 mm. From the stapling head 32 to the abutment stop 30 there is provided a sloping top guide 65 which at the abutment stop 30 is a short distance of, for example, 5 mm above the surface 10. A guide 66 with flexible fingers 67 extends beneath the upstream folding roller 11 and prevents supplied sheets from colliding with this folding roller. During the folding operation, the flexible fingers 67 bend between grooves on the associated folding roller in order to be able to press the sheets straight into the folding nip.

Figure 8:
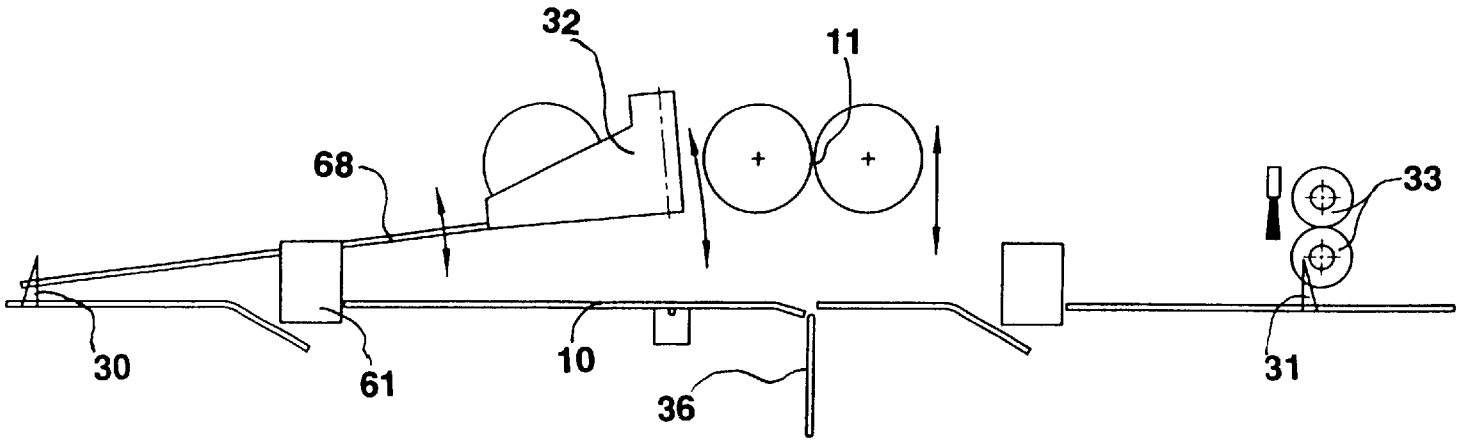
FIG. 8 shows a second embodiment of a part of a device according to the invention.

In the embodiment shown in FIG. 8, the stop 31 is kept at a distance from the stop 30 smaller than the shortest sheet of the sheets for collection in order to keep a loop formation in the sheets between the stops. With sheet length tolerances of +/−2 mm and construction tolerances of +/−2 mm and a guaranteed loop in the case of the longest sheets, the distance set between the stops 30 and 31 for the shortest sheets will already be 6 mm smaller than the shortest sheet. This gives a loop height of about 20 mm. For collection with a loop formation, the folding rollers and the stapling head must be set during collection at a distance of 30 mm above the collecting tray 10 in order to ensure that the sheets do not jam. For the stapling and folding of the collected sheets the loop in the sheets must be guaranteed to be situated between the folding rollers 11, and the stop 31. For this purpose, after collection, the top guide 68 together with the stapling heads 32 and the folding rollers 11 are moved down in the direction of the arrow in order to press away any loop forming between the stop 30 and the folding rollers 11. The advantage of the collection with a loop formation is that the flexible sheet guide 66, 67 shown in FIG. 7 is superfluous and the downwardly movable folding rollers can be brought to a position just above the collected sheets, this being favorable for good folding. In this case, the sheets cannot readily shift over the folding blade during the (short) upward movement of the folding blade 36.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A folding device in which a plurality of sheets are folded together to form a booklet, which comprises a folding station for double-folding said plurality of sheets, said folding station being provided with folding means disposed of a fixed location and a collecting station for collecting the plurality of sheets, said folding means being positioned for folding the collected sheets together on their intended fold line, a feed path for feeding the sheet to be folded to the folding station and adjustable positioning means for positioning the unfolded sheet with respect to the folding means for folding the sheet on its intended fold line, wherein the feed path is provided with measuring means for measuring the length of a supplied sheet and the adjustable positioning means are adjustable to the length of said supplied sheet as measured by the measuring means, whereby exact positioning of said sheet with its intended fold line positioned opposite the folding means can be achieved.

2. The folding device according to claim 1, wherein the positioning means comprise a first stop, said first stop being adjustable in the sheet feed direction to a distance from the folding means corresponding to one-half of the length of the sheet as measured by the measuring means plus a predetermined distance.

3. The folding device according to claim 2, wherein the first stop, after the sheets have been collected against it, is movable over the predetermined distance in a direction opposed to the sheet feed direction.

4. The folding device according to claim 2, wherein the adjustable positioning means further comprise a second stop for the trailing edge of the supplied sheet, said second stop, when considered in the sheet feed direction, being adjustable to a distance from the first stop corresponding to the length of said sheet, as measured by the measuring means.

5. The folding device according to claim 4, wherein the second stop together with the first stop is movable over the predetermined distance in a direction opposed to the sheet feed direction.

6. The folding device according to claim 2, in which a plurality of sheets are introduced in sequence to form a booklet, wherein during the feeding of a sheet belonging to a booklet, the first stop is adjusted on the basis of the measured length of said sheet only when the measured length of said sheet is greater than the measured length of each previously supplied sheet belonging to the same booklet.

7. The folding device according to claim 4, in which a plurality of sheets are introduced in sequence to form a booklet, wherein during the feeding of a sheet belonging to a booklet, the second stop is adjusted to a distance from the first stop corresponding to the measured length of said sheet only when the measured length of said sheet is greater than the measured length of each previously supplied sheet belonging to the same booklet.

8. The folding device according to claim 7, wherein the adjusted distance between the first stop and the second stop is, at a minimum, equal to the measured length of said sheet.

9. The folding device according to claim 8, wherein the folding means comprises two folding rollers which form a folding nip disposed a short distance above a sheet collecting station, a folding blade disposed below the collecting station, said folding blade mounted for movement through an aperture provided in said collecting station, whereby the folding blade presses individual collected sheets with the intended fold line into the folding nip, and wherein a sheet guide extends around the upstream roller of said two folding rollers, when considered in the sheet feed direction, said sheet guide being flexible at least in the portion between the upstream folding roller and the plane of the folding blade so that the flexible portion of the sheet guide can be pushed away by a sheet pressed into the folding nip by the folding blade, into a groove formed by said folding rollers.

10. The folding device according to claim 7, wherein the adjusted distance between the first and second stops is, at a maximum, equal to the measured length of said sheet.

11. The folding device according to claim 10, wherein the folding means comprise two folding rollers displaceable between a position distant from the collecting station for permitting an unobstructed supply of sheets between the folding rollers and the collecting station and a position closer to the collecting station in which the sheets are pressed between the folding rollers by a folding blade disposed beneath the collecting station.

12. The folding device according to claim 1, wherein the measuring means comprises a measuring wheel mounted to be freely rotatable in the feed path and pressing at a pressure point on a guide plate forming the feed path.

13. The folding device according to claim 12, wherein at the pressure point the guide plate is bent in the opposite direction to the measuring wheel.

14. A folding device in which a plurality of sheets are introduced in sequence to form a booklet which comprises:

a folding station for double-folding said plurality of sheets, said folding station being provided with folding means disposed at a fixed location, a feed path for feeding the sheets to be folded to the folding station, and adjustable positioning means for positioning the unfolded sheets with respect to the folding means for folding the sheet on its intended fold line, wherein the feed path is provided with measuring means for measuring the length of a supplied sheet, said adjustable positioning means being adjustable to the length of said supplied sheet as measured by measuring means and comprising a first stop, said first stop being adjustable in the sheet feed direction to a distance from the folding means corresponding to the one-half of the length of the sheet, as measured by the measuring means plus a predetermined distance, wherein during the feeding of a sheet belonging to the booklet, the first stop is adjusted on the basis of the measured length of said sheet only when the measured length of said sheet is greater than the measured length of each previously supplied sheet belonging to the same booklet, whereby the exact positioning of said sheet with its intended fold line positioned opposite the folding means can be achieved.

* * * * *